United States Patent [19]

Hettich et al.

[11] 3,975,791

[45] Aug. 24, 1976

[54] DOOR CLOSING DEVICE

[75] Inventors: Anton Hettich, Herford-Schwarzenmoor; Udo Stellbrink, Stift-Quernheim; Günter Sundermeier, Bunde-Dunne, all of Germany

[73] Assignee: Kunststoff GmbH, Herford, Germany

[22] Filed: Aug. 30, 1973

[21] Appl. No.: 393,144

Related U.S. Application Data

[62] Division of Ser. No. 57,412, June 8, 1970, Pat. No. 3,772,736.

[30] Foreign Application Priority Data

June 10, 1969 Germany ..... 6923018

[52] U.S. Cl. ..... 16/72; 16/145; 16/147; 16/180

[51] Int. Cl.[2] ..... E05F 1/12

[58] Field of Search ..... 16/180, 190, 145, 147, 16/49, 72, 80, 85, 163; 292/78, 79

[56] References Cited

UNITED STATES PATENTS

| | | | |
|---|---|---|---|
| 432,119 | 7/1890 | Crocker | 16/145 |
| 801,829 | 10/1905 | Hall | 292/79 X |
| 2,224,444 | 12/1940 | Murrin | 16/190 |
| 2,762,641 | 9/1956 | Gilmour | 16/85 X |
| 2,869,171 | 1/1959 | Levine | 16/85 X |
| 2,940,116 | 6/1960 | Salice | 16/190 X |
| 3,156,003 | 11/1964 | Schmid | 292/79 X |
| 3,362,042 | 1/1968 | Salice | 16/163 |
| 3,418,683 | 12/1968 | Stone et al. | 16/145 |
| 3,564,643 | 2/1971 | Salice | 16/163 |
| 3,590,420 | 7/1971 | Salice | 16/145 X |
| 3,724,021 | 4/1973 | Lautenschläeger | 16/163 |

FOREIGN PATENTS OR APPLICATIONS

| | | | |
|---|---|---|---|
| 1,306,159 | 9/1962 | France | 16/145 |
| 1,090,135 | 9/1960 | Germany | 292/79 |
| 487,559 | 12/1953 | Italy | 16/190 |

*Primary Examiner*—Roy D. Frazier
*Assistant Examiner*—William E. Lyddane
*Attorney, Agent, or Firm*—Michael J. Striker

[57] ABSTRACT

A piece of furniture has a door or panel swingably mounted by means of a hinge. An elongated biased stud is mounted on a wall of the furniture piece pivotable in such manner that its free end engages the hinge and urges the door to closed position only during the initial increment of the door's movement to open position and the final increment of the door's movement to closed position.

10 Claims, 5 Drawing Figures

2
1
10
15
11
51
9
16
8
17
12
20
3
13
19
14
18
4
5
7

2
22
21
IV
32
36
28
34
26
27
23
30
35
37
41
33
24
40
25
7

DOOR CLOSING DEVICE

BACKGROUND OF THE INVENTION

This is a division of application Ser. No. 57,412. filed on June 8, 1970, now U.S. Pat. No. 5,772,736.

The present invention relates to furniture, and more specifically to furniture having a swingably mounted door, panel or analogous element.

Such an element, hereafter referred to as the "the door" for the sake of simplicity, is usually mounted for swinging or pivoting movement by means of a hinge which in many cases is of the type known as a "piano hinge", and which is frequently provided with a housing recessed in a corresponding depression at the inner side of the door.

It is obviously desirable to assure that the door will normally remain in its closed position, and accordingly a wide variety of devices for achieving this purpose has become known. Some of these are more efficient than others, just as some of them are simpler and others more complicated, while still further ones are aesthetically more pleasing than others. However, thus far no such device has become known which is entirely satisfactory.

In particular, devices of the type which actively urge the door to closed position — rather than merely holding it in such position — do so irrespective of the position of the door. In other words, their biasing action is constant so that the door must be opened against this bias and must be held open to keep it from "slamming" shut. This is evidently undesirable, not only because of the inconvenience to the user and the noise potential, but also because of the possibility of damage to the furniture piece, e.g., marring of the finish.

SUMMARY OF THE INVENTION

It is, accordingly, an object of the invention to overcome the above-discussed disadvantages.

More particularly, it is an object of the invention to provide an arrangement in a piece of furniture of the type discussed, which is not possessed of these disadvantages.

Another object of the invention is to provide such an arrangement which is simple in its construction and can be readily installed.

Still a further object of the invention is to provide an arrangement of the type under discussion, which can be used irrespective of whether the opening angle is in excess of 90° or not.

In pursuance of the above objects, and others which will become apparent hereafter, one embodiment of the invention comprises, briefly stated, a wall and a door which is carried by this wall and has hinge means secured both to the wall and to one edge of the door. The latter is thus swingably mounted on the wall for movement about a first axis between an open and a closed position.

Pivotal means is mounted on the wall proximal to the hinge means for pivotal movement about a second axis parallel to the first axis; this pivotal means is operative for urging the door to closed position only in an initial phase of movement of the door towards open position, and in a terminal phase of movement of the door toward closed position.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
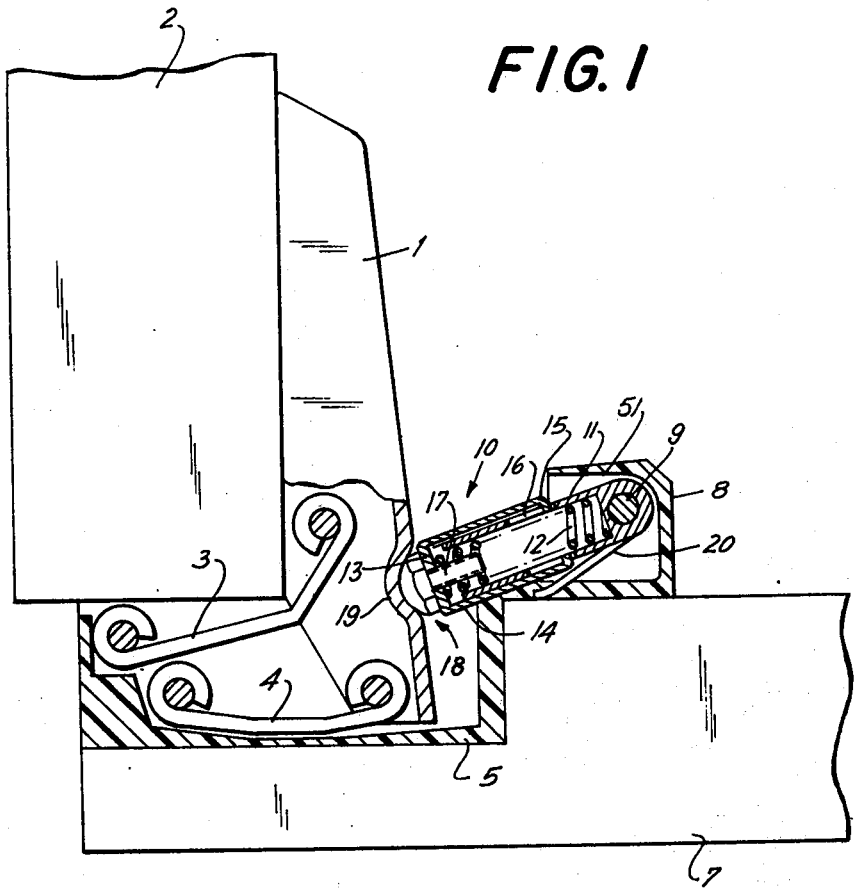
FIG. 1 is a fragmentary partially sectioned view showing one embodiment of the invention, with the door in closed position.
Figure 2:
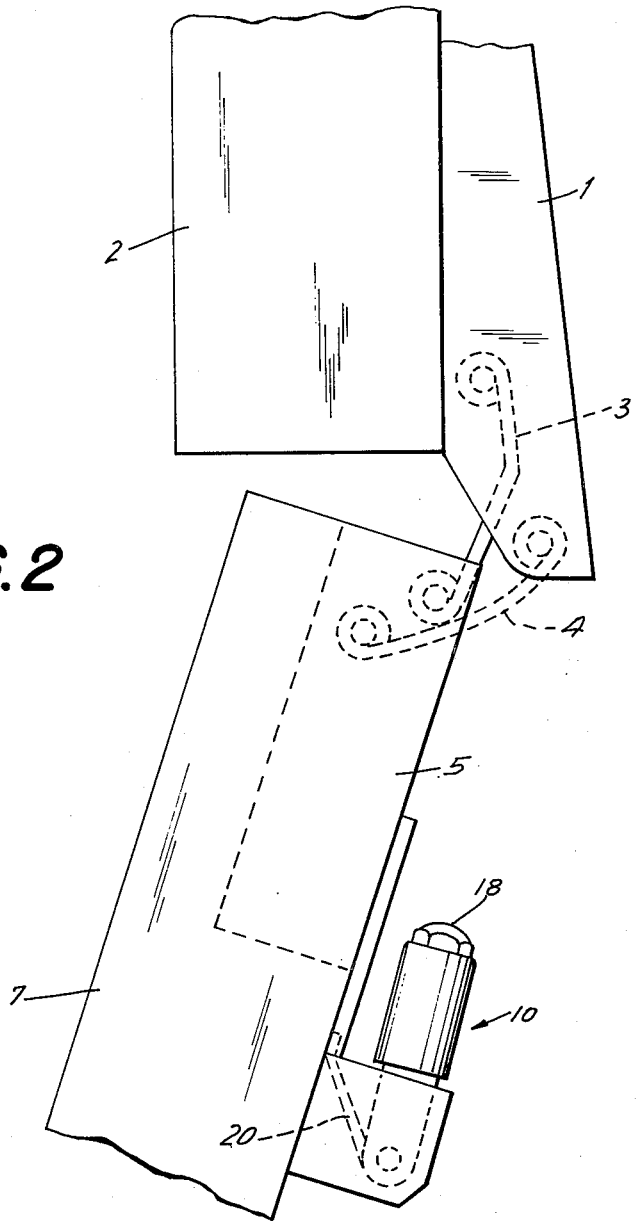
FIG. 2 is a somewhat diagrammatic view of the embodiment in FIG. 1, showing the door in open position.

Discussing now firstly the embodiment shown in FIGS. 1 and 2, it will be seen that the door of a piece of furniture is identified with reference numeral 7. A wall of the piece of furniture is identified with reference numeral 2; a more complete showing of the piece is not necessary for an understanding of the invention.

The inwardly facing side of the door 7, that is the one facing the interior of the piece of furniture, is provided with a recess or depression in which there is located a housing 5 — usually of cylindrical configuration — connected, via a hinge linkage composed of the members 3 and 4, with a hinge strap 1. The latter is mounted on the wall 2 by means of (non-illustrated) screws or analogous fasteners.

Connected with the housing 5 is a housing 8; in the illustrated embodiment they are of one piece with one another and can be readily fabricated from synthetic plastic material. Housing 8 accommodates a pivot 9 for an elongated stud member 10 which is of the telescopic type, i.e., composed of an inner tubular section 11 which is telescoped into an outer tubular section 14. In the interior of the stud member is accommodated a restoring spring 12 which bears upon the bottom wall of section 11 and upon the endplate 13 of the section 14, as shown. The endplate 13 has a tapped bore into which the shaft 17 of an adjusting screw 18 is threaded. The purpose of screw 18 is to permit compensation for manufacturing tolerances or for material fatigue of the restoring spring 12.

On its side facing towards the center of the door, i.e., towards the free edge of the door, the outer section 14 is provided with ribs which extend into slots 16 provided in the inner section 11, the purpose being to limit the relative displacement possible between the sections 11 and 14.

As FIGS. 1 and 2 show, the hinge strap 1 is provided with a depression 19 in which the head of screw 18 can become lodged. FIG. 1 shows clearly that as the door 7 is moved from closed towards open position, the movement will be resisted in its initial phase by the fact that the head of screw 18 is lodged in recess 19, with the result that member 10 urges door 7 to closed position. However, when the initial phase of the movement has been carried out against this biasing action, that is when the door 7 assumes a certain angular position with reference to wall 2, the head of screw 18 becomes disloged from recess 19 and the door can now be moved the rest of the way towards open position without having to overcome any further bias. Note should be taken that a spring 20 urges the member 10 into abutment with an abutment face 51 of the housing 8 when disengagement takes place.

Conversely, of course, the head of screw 18 becomes lodged again in recess 19 when the door is moved towards closed position, so that the last phase of the closing movement is assisted by the biasing action of the member 10.

Figure 3:
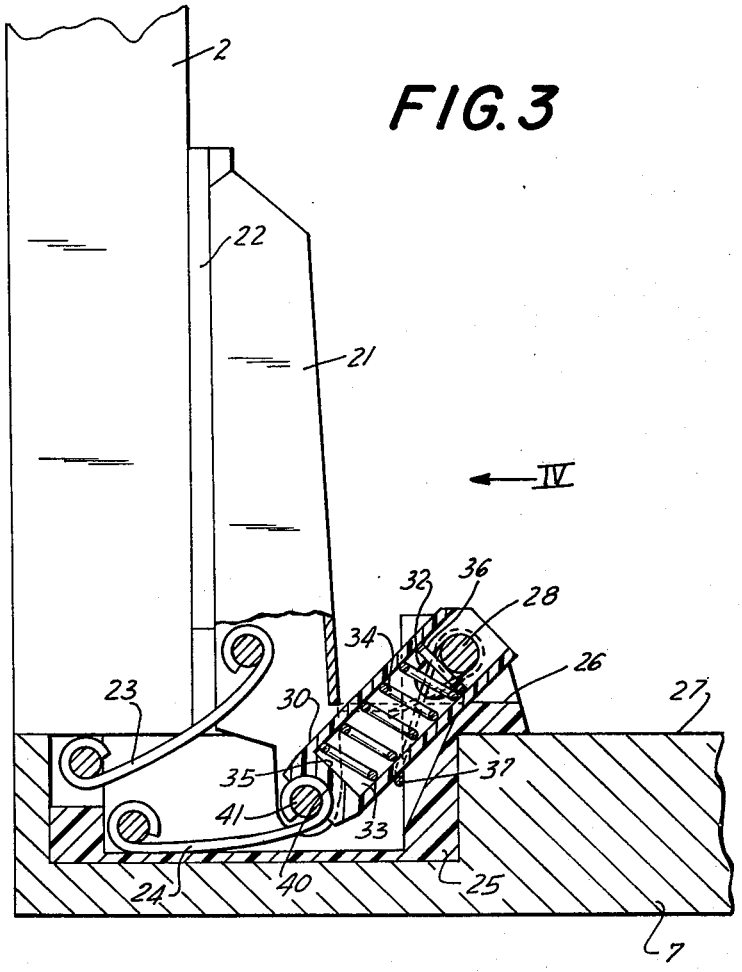
FIG. 3 is a view similar to FIG. 1 but of a further embodiment of the invention.
Figure 4:
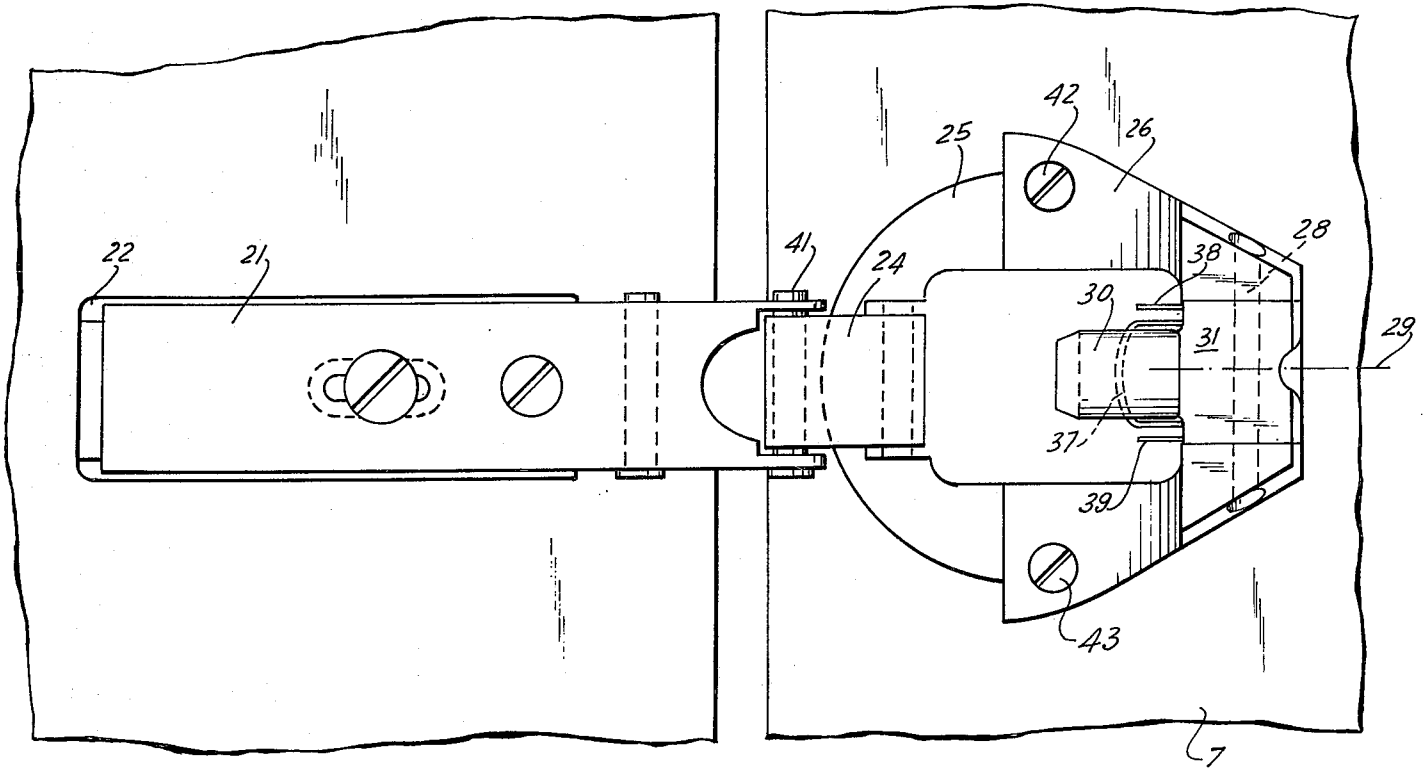
FIG. 4 is a detail view of FIG. 3, as seen in the direction of the arrow IV and with the door in open position.

The embodiment of FIGS. 3 and 4 is somewhat different from that of FIGS. 1 and 2. Here, the hinge strap 21 is secured in known manner on a member 22 which in turn is made fast with the wall 2.

The housing 5 is here replaced with a housing 25 which is secured to door 7 via screws 42, 43 and connected with hinge strap 21 by means of the arms 23 and 24. A second housing 26 is of one piece with the housing 25 and abuts against the inner side 27 of the door 7.

A pivot pin 28 is mounted in the housing 26, defining a pivot axis which extends normal to center plane 29 of the described hinge. The stud member is here identified with reference numeral 30 and is of one piece with a block member or block portion 31, the latter being provided with a slot-shaped opening 32. The chamber 33 in the stud member 30 accommodates a restoring spring 34 which bears at one end upon the surface 35 and at the other end upon a disc 36 which is fixed by the pivot pin 28.

A torsion spring surrounds the pivot pin 28 at opposite sides of the stud member 30, with the latter resting upon a loop 37 of the spring. The free portions 38 and 39 of this torsion spring bear upon an edge of housing 26.

FIG. 3 shows clearly that the free end of stud member 30 is provided with a depression 40. This depression engages in the region of the pivot axis 41 of the strap 21 that portion of arm 24 which surrounds this pivot axis 41, and this engagement takes place during the initial phase of the door-opening movement and during the terminal phase of the door-closing movement. The operation is then the same as in the preceding embodiment.

Figure 5:
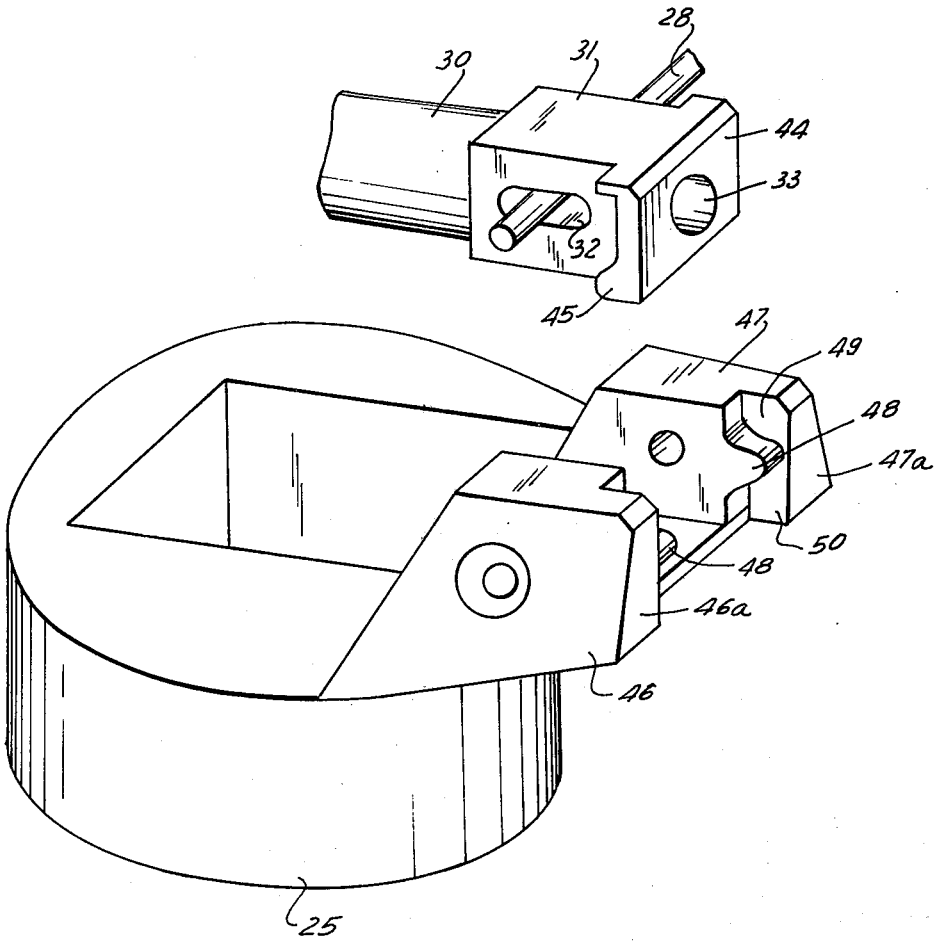
FIG. 5 is an exploded perspective view of still another embodiment.

The final exemplary embodiment is that of FIG. 5 which differs from FIGS. 3 and 4 primarily in the omission of the torsion spring. Here, the arresting of stud member 30 in the position it assumes when the door is open and closed, respectively, is accomplished by utilizing the displacement of stud member 30 in lengthwise direction during the opening and closing movements. The block member 31, which is again present, is provided with an endplate 44 which has abutments 45 projecting at the side facing towards the stud member 30. These cooperate (see FIG. 5) with abutments 48 provided at the inner sides of sidewalls 46, 47 of the housing 26.

When the door is closed, the abutments 45 are located in the recess 49 which is illustrated. During movement of the door towards open position, the stud member 30 is compressed rearwardly in its axial direction, causing the abutments 45 to move past the abutments 48 and — when the spring 34 is subsequently released — to enter into the recess 50 whereby the stud member 30 is arrested against further movement. In this position, the endplate 44 covers the recesses 49 and 50 and is flush with edge faces 46*e*, 47*a* of the side walls 46, 47.

Conversely, when the door is subsequently moved towards closed position, the stud member 30 is again compressed axially against the force of spring 34, but only during the terminal phase of the door movement. This causes the abutment 45 to move past the abutments 48. It should be noted that the recesses 49 have been made large enough so that the abutments 45 will have no contact therein, thereby assuring that the entire biasing force of spring 34 acts upon the door in a sense urging it to its closed position.

It will be understood that each of the elements described above, or two or more together, may also find a useful application in other types of constructions and applications differing from the types described above.

While the invention has been illustrated and described as embodied in a piece of furniture, it is not intended to be limited to the details shown, since various modifications and structural changes may be made without departing in any way from the spirit of the present invention.

Without further analysis, the foregoing will so fully reveal the gist of the present invention that others can be applying current knowledge readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended:

1. In a piece of furniture, a combination comprising a wall; a door carried by said wall; a hinge mounting said door on said wall, said hinge including a hinge strap mounting said door for swinging movement about a first axis between an open and a closed position; a housing having a housing section recessed in said door and provided with an opening at an inner side of said door and adjacent said hinge strap; an elongated stud on said door, said stud having an end outside said housing section and remote from said hinge strap which is mounted for pivoting movement about a second axis substantially parallel to but spaced from said first axis, said stud also having a free end facing toward said hinge strap; biasing means acting upon said stud lengthwise of the same and biasing at least part of said stud transversely of said second axis and of said opening in the direction of said hinge strap, said free end of said stud moving to a position in which it engages said hinge strap and biases said door to said closed position only in an initial phase of movement of said door towards said open position and in a terminal phase of movement of said door towards said closed position; and means associated with said stud for limiting movement of said stud in lengthwise direction thereof so as to permit engagement of said free end of said stud with said hinge strap only in said initial and terminal phase of movement.

2. A combination as defined in claim 1, wherein said stud includes two telescoped-together tubular sections, and wherein said biasing means is a spring which is accommodated in said sections and tends to move the same axially apart.

3. A combination as defined in claim 2, wherein one of said tubular sections has at least one axially extending slot, and the other of said tubular sections has a corresponding rib which is slidably received in said slot and limits relative axial displacement of said tubular sections.

4. A combination as defined in claim 3, wherein said other section is the outer one of said telescoped-together sections, and wherein said rib is provided on a side of said outer section which faces towards an edge of said door which is spaced from and parallels said one edge.

5. A combination as defined in claim 1, wherein said stud has a transverse endwall at said free end and is provided with a bore therein; and further comprising an adjusting screw threaded into said bore and operative for adjusting the length of said stud.

6. A combination as defined in claim 1, wherein said housing comprises a wall portion positioned for abutment with said stud when said door moves towards said open position thereof.

7. A combination as defined in claim 1, wherein said housing is of one piece.

8. A combination as defined in claim 1, wherein said stud includes a portion having an elongated slot, and wherein said second axis passes through said slot.

9. A combination as defined in claim 8, further comprising a pin defining said second axis and extending through said slot, and a torsion spring surrounding said pin and having a loop on which said stud abuts; and wherein said biasing means is a biasing spring located between said pin and said stud.

10. In a piece of furniture, a combination comprising a wall; a door carried by said wall and mounted for swinging movement about a first axis between an open and a closed position; a housing having a housing section recessed in said door and provided with an opening having a first lateral side closer to and a second lateral side farther from said wall when said door is in said open position; a hinge mounting said door on said wall, said hinge including an elongated hinge strap secured to said wall and having an end portion connected to said housing adjacent said first side of swinging movement about said first axis; an elongated stud on said housing, said stud having an end remote from said end portion of said hinge strap which is mounted for pivoting movement about a second axis substantially parallel to said first axis, and said stud extending across said opening toward but short of said end portion of said hinge strap when said door is in said open position and having a free end facing said end portion; biasing means acting upon said stud lengthwise of the same and biasing at least part of said stud transversely of said second axis and of said opening in the direction of said end portion of said hinge strap, said free end of said stud engaging said end portion of said hinge strap and biasing said door to said closed position only in an initial phase of movement of said door towards said open position and in a terminal phase of movement of said door towards said closed position; and means associated with said stud for limiting movement of said stud in lengthwise direction thereof so as to permit engagement of said free end of said stud with said end portion of said hinge strap only in said initial and terminal phases of movement.

* * * * *